US011844438B2

(12) United States Patent
Forte

(10) Patent No.: US 11,844,438 B2
(45) Date of Patent: Dec. 19, 2023

(54) APPARATUS AND METHOD FOR HYGIENICALLY PROTECTING AND AESTHETICALLY PREPARING A SEAT

(71) Applicant: Eva Forte, Flushing, NY (US)

(72) Inventor: Eva Forte, Flushing, NY (US)

( * ) Notice: Subject to any disclaimer, the term of this patent is extended or adjusted under 35 U.S.C. 154(b) by 0 days.

(21) Appl. No.: 17/656,198

(22) Filed: Mar. 23, 2022

(65) Prior Publication Data

US 2022/0211190 A1 Jul. 7, 2022

Related U.S. Application Data

(63) Continuation-in-part of application No. 17/013,134, filed on Sep. 4, 2020, now abandoned, which is a continuation-in-part of application No. 16/252,867, filed on Jan. 21, 2019, now abandoned.

(51) Int. Cl.
*A47C 31/11* (2006.01)

(52) U.S. Cl.
CPC ..... *A47C 31/11* (2013.01)

(58) Field of Classification Search
CPC ..... A47C 31/11; A47K 10/02
See application file for complete search history.

(56) References Cited

U.S. PATENT DOCUMENTS 4,278,719 A 7/1981 Sarnecki
4,478,453 A 10/1984 Schutz
4,634,618 A * 1/1987 Greer ..... A47G 9/062 428/126
4,676,376 A 6/1987 Keiswetter
4,694,511 A 9/1987 Estes et al.
4,856,912 A * 8/1989 Damus ..... A45F 4/02 33/270
5,386,603 A 2/1995 Drust
5,735,004 A 4/1998 Wooten et al.
5,774,912 A * 7/1998 Dominique ..... A47K 10/02 5/419
5,785,219 A * 7/1998 Kraft ..... A47G 9/066 224/901.2
5,806,925 A 9/1998 Hanley
5,906,878 A 5/1999 Horning et al.
6,186,155 B1 2/2001 Cheek
6,223,367 B1 * 5/2001 French ..... A47G 9/0207 5/419
6,309,017 B1 10/2001 Middleton
6,390,550 B1 5/2002 Paredes et al.
6,393,638 B1 * 5/2002 MacColl ..... B60N 2/60 5/419
6,626,491 B1 9/2003 Blome et al.
7,076,816 B1 * 7/2006 Nielsen ..... A47G 9/062 383/4

(Continued)

FOREIGN PATENT DOCUMENTS

EP 3326699 A1 5/2018
FR 2682301 A1 * 4/1993 ..... A47K 10/02

*Primary Examiner* — Timothy J Brindley
(74) *Attorney, Agent, or Firm* — INNOVATION CAPITAL LAW GROUP, LLP; Vic Lin

(57) ABSTRACT

A method of hygienically and aesthetically preparing a seat uses a seat cover having a 100% natural fiber top-side and a non-slip vinyl/polymer backing layer. The seat cover can be attached to a pocket for convenient and hygienic storage when not in use. The seat cover may include one or more straps on its bottom side for securing the seat cover to a seat.

20 Claims, 6 Drawing Sheets

(56) References Cited

U.S. PATENT DOCUMENTS

| | | | | |
|---|---|---|---|---|
| 7,601,655 | B2 * | 10/2009 | Katsin | B32B 5/06 428/92 |
| 7,779,492 | B2 | 8/2010 | Mangano | |
| 8,042,195 | B1 | 10/2011 | Massey | |
| D696,532 | S | 12/2013 | Von Saher | |
| 9,138,060 | B2 | 9/2015 | Vainberg et al. | |
| 9,221,372 | B1 | 12/2015 | Lacey | |
| 9,403,462 | B2 | 8/2016 | Spitzer | |
| 10,172,466 | B2 | 1/2019 | DuVall | |
| 10,188,220 | B2 | 1/2019 | Reaves | |
| 2004/0212230 | A1 | 10/2004 | Hanks | |
| 2005/0057080 | A1 | 3/2005 | Collins | |
| 2005/0069672 | A1 | 3/2005 | Katsin | |
| 2005/0082886 | A1 | 4/2005 | Sganga | |
| 2005/0236876 | A1 | 10/2005 | Paulin | |
| 2007/0007803 | A1 | 1/2007 | Lawler | |
| 2007/0145798 | A1 | 6/2007 | Nadler-Sachs | |
| 2008/0084099 | A1 | 4/2008 | Palgon | |
| 2009/0140563 | A1 | 6/2009 | Placide | |
| 2010/0178821 | A1 | 7/2010 | Morris | |
| 2011/0012404 | A1 | 1/2011 | Cariera | |
| 2011/0049951 | A1 | 3/2011 | Bettencourt | |
| 2011/0198904 | A1 | 8/2011 | Thomas et al. | |
| 2012/0019031 | A1 | 1/2012 | Bessert | |
| 2012/0210517 | A1 | 8/2012 | Patel | |
| 2012/0313410 | A1 | 12/2012 | Paulin | |
| 2013/0019397 | A1 | 1/2013 | May | |
| 2013/0320720 | A1 | 12/2013 | Steinmetz | |
| 2014/0008949 | A1 | 1/2014 | Mullin et al. | |
| 2014/0110442 | A1 * | 4/2014 | Midgett | A47K 10/02 224/153 |
| 2014/0145478 | A1 | 5/2014 | Boston | |
| 2015/0115674 | A1 * | 4/2015 | Watson | A47C 31/11 297/220 |
| 2016/0023582 | A1 | 1/2016 | Looper | |
| 2016/0129819 | A1 | 5/2016 | Johnson, Jr. et al. | |
| 2016/0192719 | A1 | 7/2016 | Chrzanowska | |
| 2016/0235259 | A1 | 8/2016 | Yapoujian | |
| 2016/0316931 | A1 | 11/2016 | Trevino | |
| 2017/0196410 | A1 * | 7/2017 | Andresen | A47K 3/062 |
| 2017/0360214 | A1 | 12/2017 | Jensen | |
| 2018/0027987 | A1 | 2/2018 | Calhoun et al. | |
| 2018/0353801 | A1 * | 12/2018 | Ruse | A47K 10/02 |
| 2019/0045943 | A1 * | 2/2019 | Heasley | A47C 31/11 |
| 2019/0261781 | A1 * | 8/2019 | Hoensheid | A45C 13/103 |
| 2019/0328117 | A1 * | 10/2019 | Larsen | A47C 31/11 |
| 2020/0179747 | A1 | 6/2020 | Chhabra | |
| 2020/0359851 | A1 | 11/2020 | Lucero, III | |
| 2020/0390223 | A1 * | 12/2020 | Horowitz | A45F 4/02 |

* cited by examiner

APPARATUS AND METHOD FOR HYGIENICALLY PROTECTING AND AESTHETICALLY PREPARING A SEAT

BACKGROUND OF THE INVENTION

1. Field of the Invention

Embodiments of the invention relate generally to hygienic seat coverings. More particularly, embodiments of the invention relate to an apparatus and method for hygienically and aesthetically preparing a seat, wherein the method embodies a tailored 100% natural fiber, graphically designed top-side fabric, sewn to a non-slip vinyl/polymer bottom side

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

When using public seating, such as on a bus, subway car, train, taxi, bench, or the like, many users of such seats have an inborn repulsion to the possibility that, by sitting on the seat, they may be coming in contact with something contagious or that can leave a stain, contamination, virus, bacteria, or odor on their person clothing.

As can be seen, there is a need for a method of hygienically and aesthetically preparing a seat, wherein the method embodies a tailored 100% natural fiber top fabric sewn to a non-slip vinyl/polymer backing placed on the seating surface. The tailored accessory may be placed over the seat portion of a chair, bench, plane seat, theater seat, park grass or the like, creating a clean and hygienic barrier between the seat and the user.

SUMMARY OF THE INVENTION

Embodiments of the present invention provide a seat cover comprising a top fabric material forming a top side of the seat cover; bottom material attached to the top fabric material along at least an outer periphery of each of the top fabric material and the bottom material, the bottom material forming a bottom side of the seat cover; a pouch having an open end; and a cord having a first end connected at a central location of an edge of the seat cover, the cord extending from the edge of the seat cover, passing through a channel formed in the open end of the pouch, and connecting back to central location of the one edge.

Embodiments of the present invention further provide a seat cover comprising a top fabric material, having a rectangular shape, forming a top side of the seat cover; a bottom material, having a rectangular shape, attached to the top fabric material along at least an outer periphery of each of the top fabric material and the bottom material, the bottom material forming a bottom side of the seat cover; a pouch having an open end; a cord having a first end connected at a central location of an edge of the seat cover, the cord extending from the edge of the seat cover, passing through a channel formed in the open end of the pouch, and connecting back to central location of the one edge; and a cord clip disposed movably positioned along the cord.

Embodiments of the present invention also provide a method for providing a barrier between a seat and a user sitting on the seat comprising opening a seat cover into a flat configuration, the seat cover including a top fabric material forming a top side of the seat cover, a bottom material attached to the top fabric material along at least an outer periphery of each of the top fabric material and the bottom material, the bottom material forming a bottom side of the seat cover, a pouch having an open end, and a cord having a first end connected at a central location of an edge of the seat cover, the cord extending from the edge of the seat cover, passing through a channel formed in the open end of the pouch, and connecting back to central location of the one edge; and placing the bottom side onto a top seating surface of the seat.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
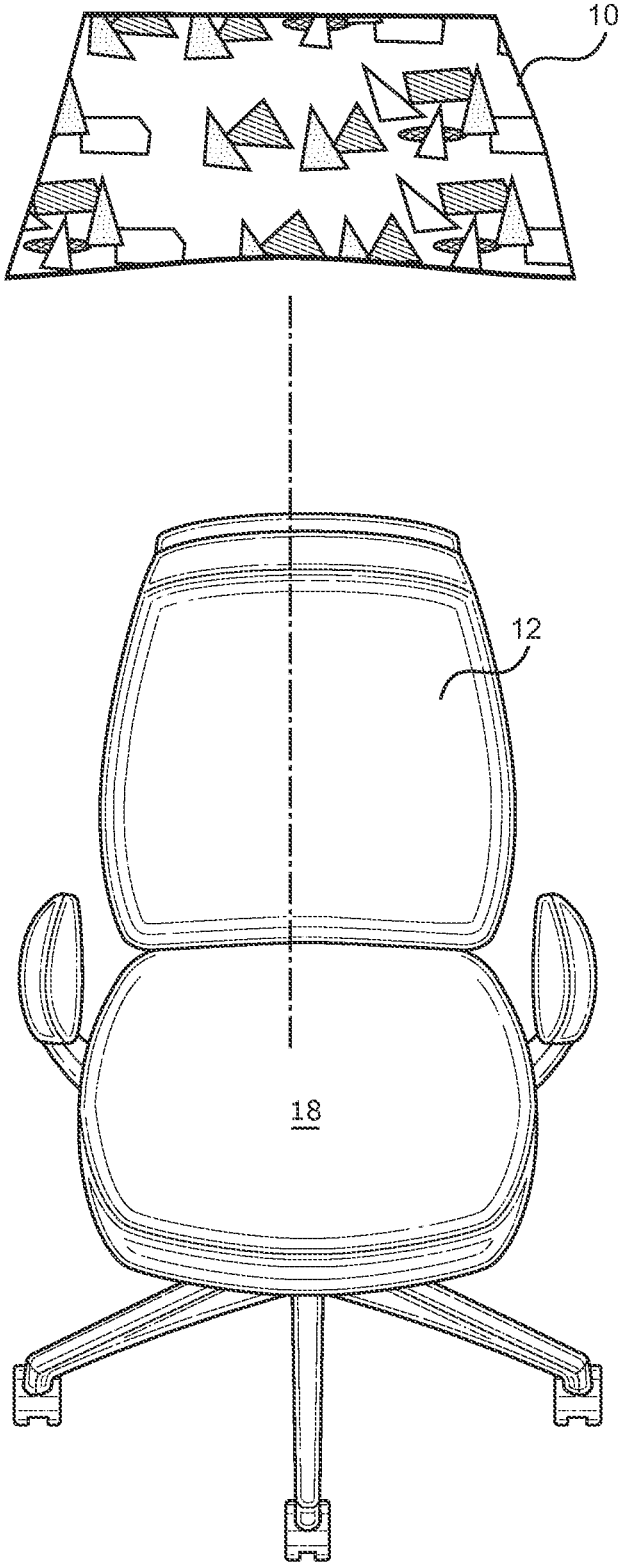
FIG. 1 illustrates an exploded perspective view of an exemplary embodiment of the present invention, shown in use.
Figure 2:
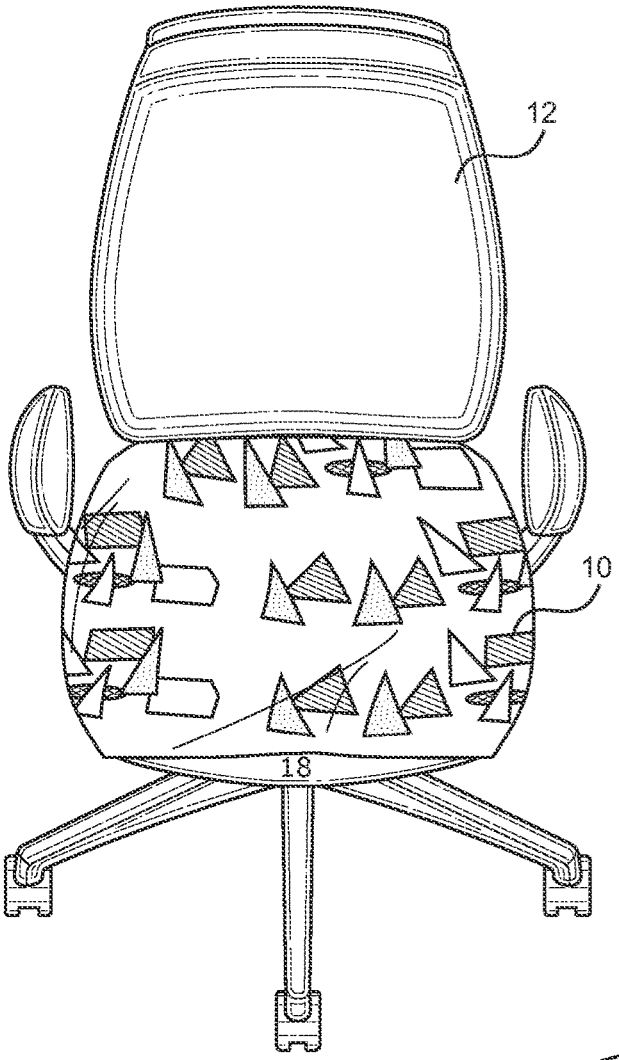
FIG. 2 illustrates a perspective view of an exemplary embodiment of the present invention, shown in use.
Figure 3:
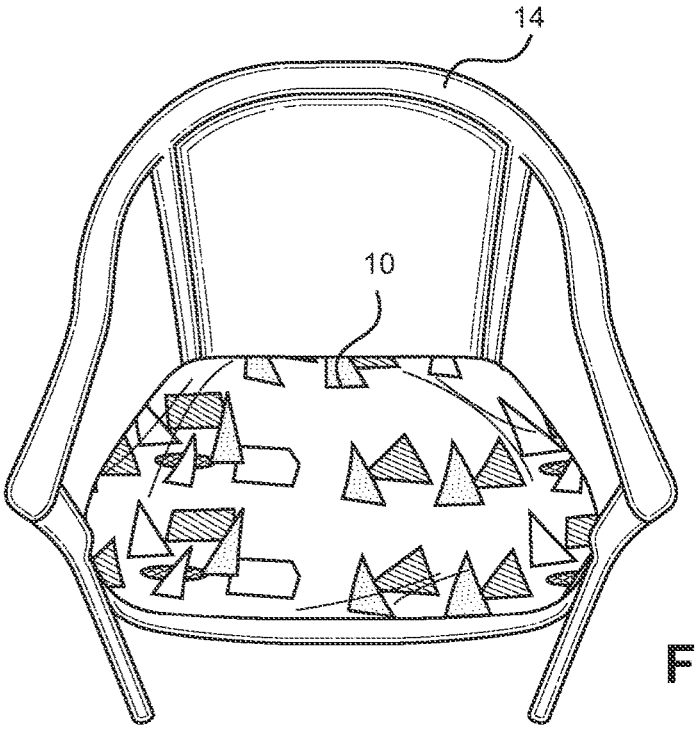
FIG. 3 illustrates a perspective view of an exemplary embodiment of the present invention, shown in use.
Figure 4:
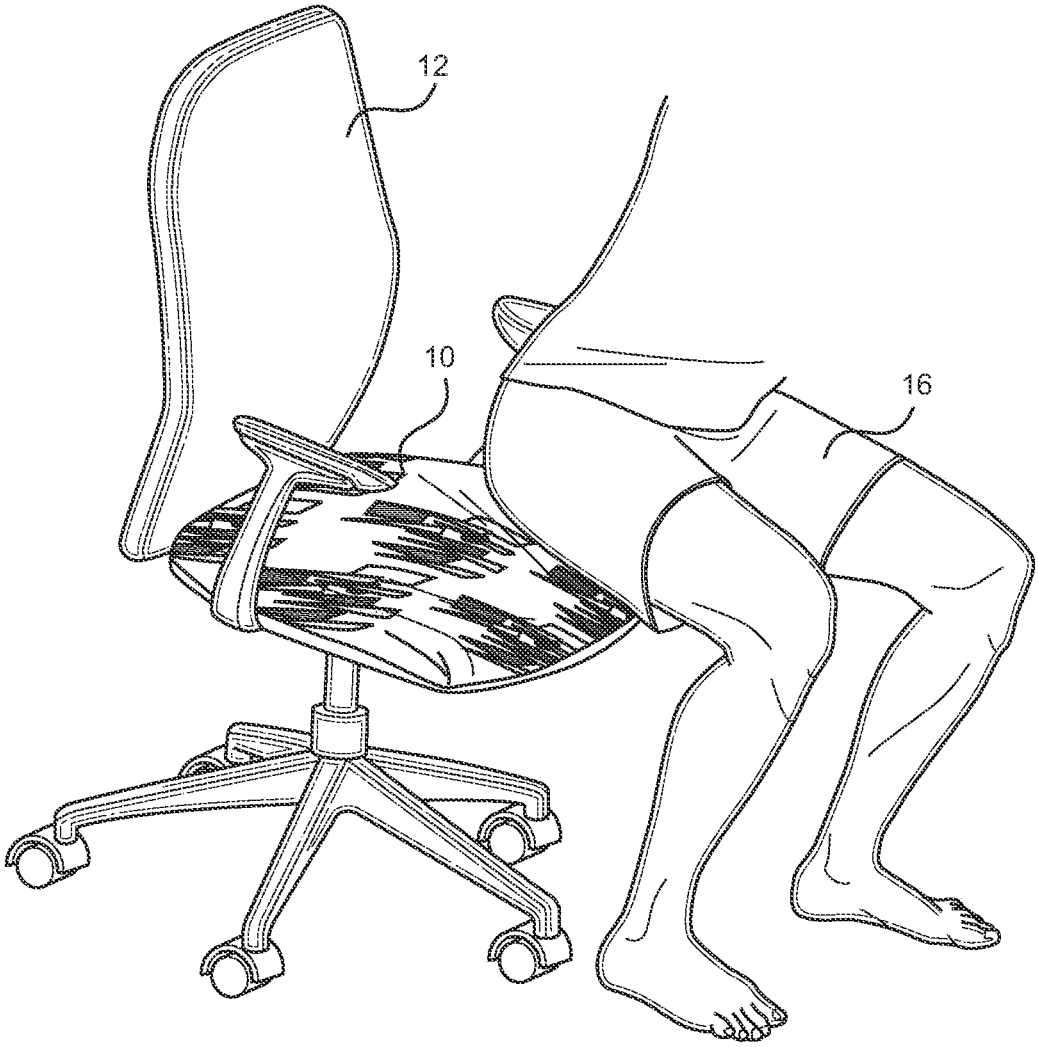
FIG. 4 illustrates a perspective view of an exemplary embodiment of the present invention, shown in use.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach (es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a method of hygienically and aesthetically preparing a seat, where a seat cover is provided having a 100% natural fiber top-side and a non-slip vinyl/polymer backing layer. The backing layer can be formed as an impermeable layer. In some embodiments, the fabric top layer and/or the backing layer can be anti-microbial. The seat cover can be attached to a pocket for convenient and hygienic storage when not in use. The seat cover may include one or more straps on its bottom side for securing the seat cover to a seat.

The seat cover is a fashionable hygienic personal protective equipment (PPE) barrier approximately 20 inches long and 15 inches wide, with a thickness from 1/16 inch to 1/18 inch, or the approximate proportions of a large formal dinner napkin. Of course, the size may vary, depending on the particular application. The seat cover can be placed by a conscientious user on the top of any seating surface, i.e., chair, park bench, subway seat, park grass or the like, before sitting down. The dimensions comfortably protect and accommodate a single occupant seat and do not overpay the protected seat's backrest or extend beyond the user's seat portion's periphery.

The top surface of the seat cover can be made from 100% natural fiber, optionally decorated, to provide breathability and the sitting user's comfort. The bottom surface can be made from a non-slip, tacky vinyl, polyvinylchloride (PVC), or polymeric material that prevents slippage and can firmly grip the seat surface without leaving any adhesion or residue on the seating surface itself. Both these sides (the top and bottom sides) can be joined and held together with perimeter stitching, for example.

The seat cover's top seating side can be made with various colors, decorative designs, graphic images and logos. Such images can assist a user in clearly distinguishing the top from the bottom, permitting the user to deploy and stow the seat cover without contacting the potentially contaminated bottom side, as discussed in greater detail below. The seat cover can be folded and held together closed with its corner or side 3.5-4 inch hanging elastic strap so that the top side never contacts the potentially soiled bottom side and conveniently stows away in a handbag, backpack or pocket.

Referring to FIGS. 1 through 4, aspects of the present invention can include a method of hygienically and aesthetically preparing a seat wherein the method embodies a tailored fabric.

The piece of tailored fabric can be a doubled squared with a 100% natural fiber decorated top-side with a non-slip vinyl/polymer bottom backing.

Size is subject to change and re-design based on the evolution of the invention. The primary method of using the seat cover can include the following. The piece of tailored fiber 10 enables the user 16 to drape the piece of tailored fabric 10 over a seat 18, such as the seat portion of a chair or bench 12 or 14, are now protected by a hygienic and clean barrier for the user 16 to sit on.

Figure 5:
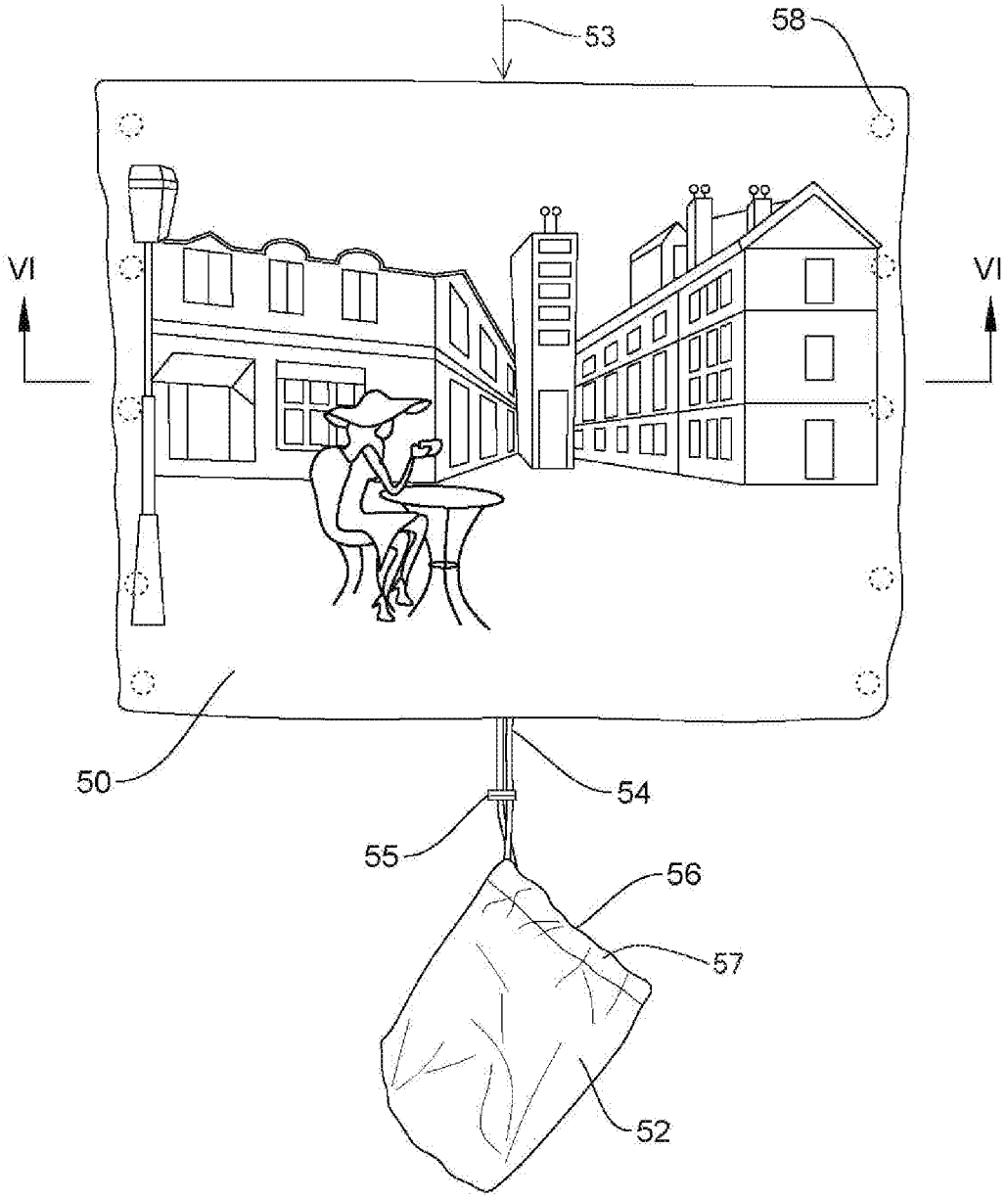
FIG. 5 illustrates a front perspective view of a seat cover according to an exemplary embodiment of the present invention.
Figure 6:
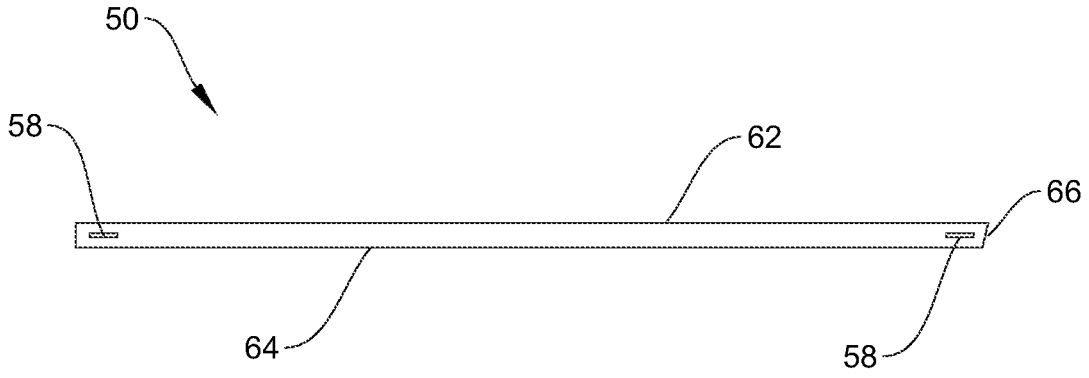
FIG. 6 illustrates cross-sectional view taken along line VI-VI of FIG. 5.
Figure 7:
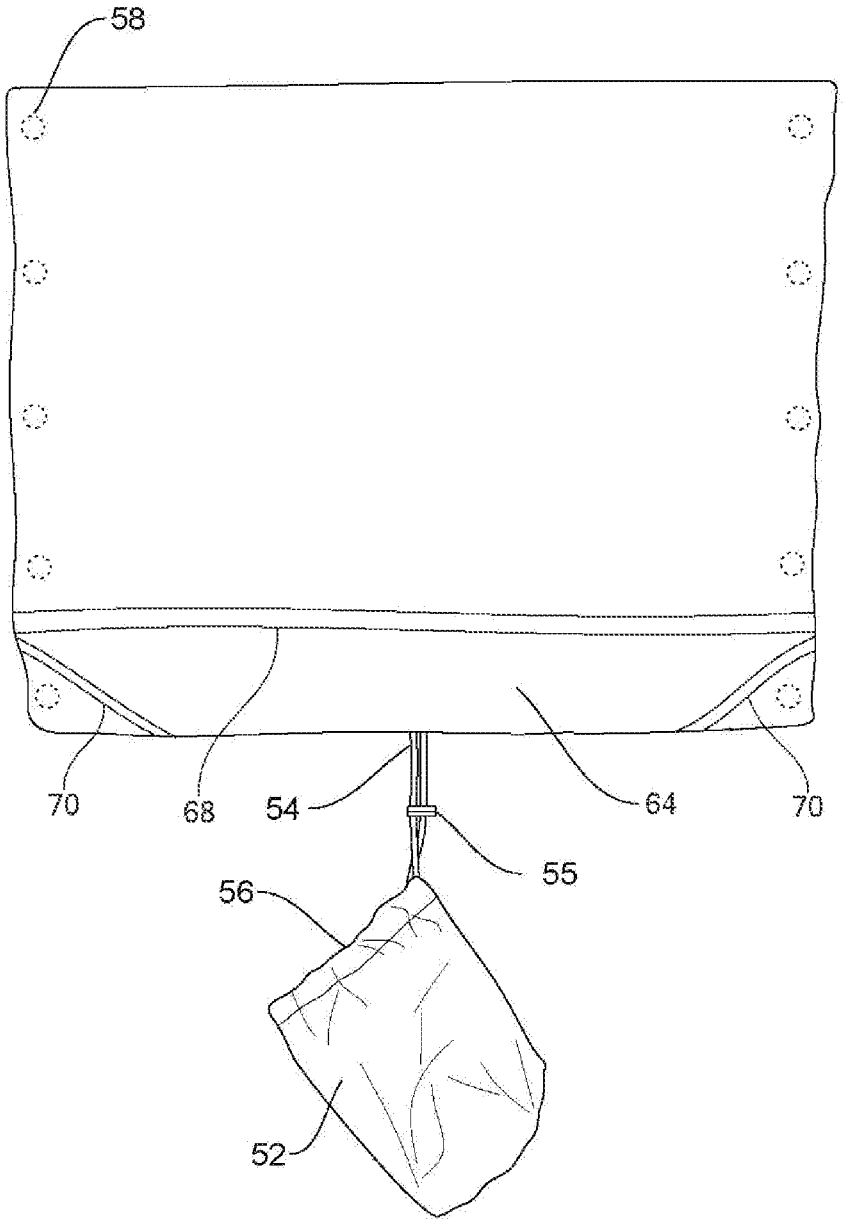
FIG. 7 illustrates a back perspective view of the seat cover of FIG. 5.

Referring now to FIGS. 5 through 7, according to another embodiment of the present invention, a seat cover 50 can include a top side 62 and a bottom side 64 connected together along an outer periphery thereof, as illustrated by connection 66. The connection 66 can be stitching, heat fusion, or any similar connection mechanism to join the top side 62 to the bottom side 64 in at least the outer periphery thereof. Typically, an entirety of the outer periphery of the top side 62 is permanently connected to the outer periphery of the bottom side 64.

Along one edge 51 thereof (hereinafter referred to as a front edge, but it should be understood that the "front edge" can be disposed on the side or back of the seat cover 10 while in use thereof), first and second ends of a cord 54 can be attached. Typically the cord 54 is attached to the edge 51 centrally along its length, as illustrated. As used herein, "centrally" refers to at or near the center of the length of the edge 51. Near the edge can be, for example, within, for example +/−10% away from the center. The position of the cord 54 along the central location of the edge 51 can assist the user in folding the seat cover 10, as discussed below.

The cord 54 can fit inside a channel 57 formed in an open end 56 of a pouch 52, where pulling the cord 54 can cinch the open end 56 to at least partially close the open end 56 for retaining the seat cover 10 inside the pouch 52, as discussed in greater detail below. A cord clasp 55 can be disposed along the cord 54. The cord clasp 55 can be slid and retained at a desired portion along the cord 54, such as a position to keep the pouch 52 in a cinched configuration. In some embodiments, the cord 54 can be an elastic cord to permit the pouch 52 to be positioned out of the way (or on the top surface 62) during use of the seat cover 50.

The pouch 52 can be formed in various sizes and typically has a length from about 5 to about 8 inches, typically about 6 to 7 inches, and a width from about 4 to about 6 inches, typically about 5 inches. The size can be selected so that the seat cover 50 can be folded and easily stored inside the pouch.

In some embodiments, a plurality of retainers 58 may be positioned along opposite sides of the seat cover 50. The retainers 58 may be, for example, small magnets, push clips, or the like, positioned in at least corners of the seat cover 50. The retainers 58 may be disposed between the top side 62 and the bottom side 64, as shown in FIG. 6, or may be disposed on a surface of the bottom side 64, for example.

A user can pick up the seat cover, along a central axis 53 to allow the opposite edges, having the retainers 58, to meet and connect to each other. This provides the bottom side 64 of the seat cover 50 folded against each other so that no portion of the bottom side 64 is then exposed to the user. The user can then appropriately fold the seat cover 50, contacting only the top side 62, to fit the folded seat cover into the pouch 52. Thus, the seat cover 50 provides not only protection for the sitting user, but also protection for the user in picking up and folding the cover for storage.

In some embodiments, as illustrated in FIG. 7, the bottom side 64 of the seat cover 50 can include one or more cover retainer devices. For example, an elastic strap 68 may extend from one side to the other for placement around the bottom of the seat, thus retaining the seat cover 50 on the seat. Typically, such an elastic strap 68 may be positioned toward a front edge 51 (see FIG. 5) of the seat cover 50 but may be disposed between the opposite sides at one or more locations along the bottom side 64 of the seat cover 50. In addition to, or in place of the elastic strap 68, one or more corner elastic straps 70 may extend between adjacent sides of the seat cover 50, straddling a corner portion thereof. The corner elastic straps 70, like the elastic strap 68, may be used to help secure the seat cover 50 to a seat. Such retention devices may be especially useful for more long term use, such as in an office chair that may be used throughout the day.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A seat cover comprising:

a top fabric material forming a top side of the seat cover;

a bottom material attached to the top fabric material along at least an outer periphery of each of the top fabric material and the bottom material, the bottom material forming a bottom side of the seat cover;

a pouch having an open end;

a cord having a first end connected at a central location of an edge of the seat cover, the cord extending from the edge of the seat cover, passing through a channel formed in the open end of the pouch, and connecting back to central location of the one edge; and at least one cover retainer extending between opposite sides of the seat cover along the bottom side thereof, the at least one cover retainer being an elastic member configured to wrap around a seat when the seat cover is disposed on the seat.

2. The seat cover of claim 1, further comprising a cord clip disposed movably positioned along the cord.

3. The seat cover of claim 1, wherein the top material is a natural fabric.

4. The seat cover of claim 1, wherein the bottom material is a non-slip material.

5. The seat cover of claim 1, wherein the bottom material is a non-permeable material.

6. The seat cover of claim 1, wherein at least one of the top material and the bottom material is antimicrobial.

7. The seat cover of claim 1, wherein at least one of the cord or pouch is formed from an elastic material.

8. A seat cover comprising:

a top fabric material forming a top side of the seat cover;

a bottom material attached to the top fabric material along at least an outer periphery of each of the top fabric material and the bottom material, the bottom material forming a bottom side of the seat cover;

a pouch having an open end;

a cord having a first end connected at a central location of an edge of the seat cover, the cord extending from the edge of the seat cover, passing through a channel formed in the open end of the pouch, and connecting back to central location of the one edge; and at least one cover retainer extending between adjacent sides of the seat cover, straddling at least one corner thereof, along the bottom side thereof, the at least one cover retainer being an elastic member configured to wrap around a seat when the seat cover is disposed on the seat.

9. The seat cover of claim 1, further comprising:

a first set of retention devices disposed along at least a portion of a first side of the seat cover;

a second set of retention devices disposed along at least a portion of a second side, opposite the first side, of the seat cover, wherein the first set of retention devices are configured to attach to respective ones of the second set of retention devices when the seat cover is folded in half with the bottom side of each half folded together.

10. The seat cover of claim 8, further comprising a cord clip disposed movably positioned along the cord.

11. The seat cover of claim 8, wherein the top material is a natural fabric.

12. The seat cover of claim 8, wherein the bottom material is a non-slip material.

13. The seat cover of claim 8, wherein the bottom material is a non-permeable material.

14. The seat cover of claim 8, wherein at least one of the top material and the bottom material is antimicrobial.

15. The seat cover of claim 8, wherein at least one of the cord or pouch is formed from an elastic material.

16. A seat cover comprising:

a top fabric material, having a rectangular shape, forming a top side of the seat cover;

a bottom material, having a rectangular shape, attached to the top fabric material along at least an outer periphery of each of the top fabric material and the bottom material, the bottom material forming a bottom side of the seat cover;

a pouch having an open end;

a cord having a first end connected at a central location of an edge of the seat cover, the cord extending from the edge of the seat cover, passing through a channel formed in the open end of the pouch, and connecting back to central location of the one edge; and a cord clip disposed movably positioned along the cord; and at least one cover retainer extending along the bottom side of the seat cover, the at least one cover retainer being an elastic member configured to wrap around a seat when the seat cover is disposed on the seat.

17. The seat cover of claim 16, wherein the top material is a natural fabric.

18. The seat cover of claim 16, wherein the bottom material is a non-slip, non-permeable material.

19. The seat cover of claim 16, wherein the cord is an elastic cord.

20. The seat cover of claim 16, further comprising:

a first set of retention devices disposed along at least a portion of a first side of the seat cover;

a second set of retention devices disposed along at least a portion of a second side, opposite the first side, of the seat cover, wherein the first set of retention devices are configured to attach to respective ones of the second set of retention devices when the seat cover is folded in half with the bottom side of each half folded together.

* * * * *